US008723786B2

(12) United States Patent
Takeuchi et al.

(10) Patent No.: US 8,723,786 B2
(45) Date of Patent: May 13, 2014

(54) LIQUID CRYSTAL DISPLAY DEVICE, AND METHOD OF DRIVING LIQUID CRYSTAL DISPLAY DEVICE

(75) Inventors: Takeya Takeuchi, Aichi (JP); Werapong Jarupoonphol, Kanagawa (JP); Tomohiko Sato, Kanagawa (JP); Yoshitoshi Kida, Kanagawa (JP)

(73) Assignee: Japan Display West Inc., Aichi (JP)

( * ) Notice: Subject to any disclaimer, the term of this patent is extended or adjusted under 35 U.S.C. 154(b) by 249 days.

(21) Appl. No.: 12/760,284

(22) Filed: Apr. 14, 2010

(65) Prior Publication Data

US 2010/0271359 A1 Oct. 28, 2010

(30) Foreign Application Priority Data

Apr. 22, 2009 (JP) ..... 2009-103933

(51) Int. Cl.
*G09G 3/36* (2006.01)

(52) U.S. Cl.
USPC ..... 345/103; 345/96

(58) Field of Classification Search
USPC ..... 345/87, 95, 96, 103
See application file for complete search history.

(56) References Cited

U.S. PATENT DOCUMENTS 6,414,729 B1 7/2002 Akiyama
6,559,824 B1 5/2003 Kubota
6,677,936 B2 * 1/2004 Jacobsen et al. ..... 345/211
6,963,335 B2 11/2005 Tanaka et al.
8,456,398 B2 6/2013 Ito et al.
2005/0052385 A1 * 3/2005 Noda ..... 345/87
2007/0002005 A1 * 1/2007 Kim et al. ..... 345/103
2008/0074377 A1 * 3/2008 Fujita ..... 345/96
2008/0088575 A1 * 4/2008 Lee et al. ..... 345/103
2009/0322660 A1 * 12/2009 Chung et al. ..... 345/87

FOREIGN PATENT DOCUMENTS

JP 11-271787 10/1999
JP 2001-259877 9/2001
JP 2001-282206 A 10/2001
JP 2005-321770 A 11/2005
JP 2009-251608 A 10/2009

* cited by examiner

*Primary Examiner* — Chanh Nguyen
*Assistant Examiner* — Roy Rabindranath
(74) *Attorney, Agent, or Firm* — Denton US LLP

(57) ABSTRACT

The present invention provides a liquid crystal display device including: a pixel array including a plurality of scanning lines arranged in rows, a plurality of signal lines arranged in columns, a plurality of liquid crystal elements arranged in a matrix corresponding to an intersection of each scanning line and each signal line, and a plurality of common connection lines arranged one by one corresponding to the liquid crystal elements of each line; a scanning line drive circuit; a signal line drive circuit; and a common connection line drive circuit electrically separating, from each other, one or a plurality of common connection lines (first common connection lines), and a plurality of common connection lines (second common connection lines), and electrically connecting the plurality of second common connection lines to each other to independently drive the first common connection line and the second connection lines from each other.

15 Claims, 16 Drawing Sheets

LIQUID CRYSTAL DISPLAY DEVICE, AND METHOD OF DRIVING LIQUID CRYSTAL DISPLAY DEVICE

BACKGROUND OF THE INVENTION

1. Field of the Invention

The present invention relates to an active matrix type liquid crystal display device, and a method of driving the same.

2. Description of the Related Art

In recent years, a liquid crystal display device in which an image is displayed by driving a display element (liquid crystal element) using a liquid crystal has been widely utilized. In such a liquid crystal display device, in a liquid crystal layer sealed between substrates of glass or the like, alignment of liquid crystal molecules is changed, and thus light from a light source is transmitted and modulated so as to perform a display.

In the liquid crystal display device, an active matrix drive is typically used. However, in this driving method, to suppress deterioration of liquid crystal, a frame inversion drive in which a polarity of a voltage applied to the liquid crystal is inverted for each frame period is performed. To suppress generation of a flicker in each frame due to the polarity inversion of the voltage applied to the liquid crystal, a line inversion drive in which the polarity of the voltage applied to the liquid crystal is inverted for each horizontal period (1H) is performed. Moreover, to reduce an amplitude of a signal voltage applied to a pixel electrode, a common inversion drive in which the polarity of the voltage applied to a common electrode is inverted is performed.

The existing driving methods described above are disclosed in Japanese Unexamined Patent Publication Nos. Hei-11-271787, and 2001-159877.

SUMMARY OF THE INVENTION

However, in the common inversion drive, the voltage of the common electrode provided in common for all pixels is positively/negatively changed in the 1H period. Thus, an extremely large amount of electric charge is necessary, and it is practically difficult to perform charge/discharge of the common electrode at high speed. In the case where the charge/discharge of the common electrode is insufficient, deterioration of image quality such as crosstalk and shading is generated. Even in the case where the common electrode may be charged/discharged at high speed, the power consumption is large. Moreover, since the voltage of the common electrode provided in common for all the pixels is positively/negatively changed in the 1H period, a so-called COM noise (audio noise) is generated. When a device sensitive to noise (for example, a capacitive touch panel) is connected to the display device, malfunction is generated. Thus, it is considered that the common electrode is provided one by one for each of the horizontal lines, and the polarity of the voltage applied to each of the common electrodes (common connection lines) is also inverted for each horizontal period (1H). Thereby, the size of the capacity generated by the common connection line of a selected pixel, and the common connection line of the other pixel electrically connected to the selected pixel is half the size of the capacity generated by the common electrode provided in common for all the pixels. As a result, it is possible to perform the charge/discharge of the common connection line while suppressing the power consumption low.

However, in the case where the polarity of the voltage applied to each of the common connection lines is inverted for each horizontal period (1H), a large electric field in the lateral direction is generated between the pixels adjacent to each other in the vertical direction. Thus, the alignment of the liquid crystal molecules is disturbed by the electric field in the lateral direction, and there is an issue that light leakage is generated.

In view of the foregoing, it is desirable to provide a liquid crystal display device capable of performing charge/discharge of a common connection line at high speed while suppressing both power consumption and light leakage low, and a method of driving the same.

According to an embodiment of the present invention, there is provided a liquid crystal display device including: a pixel array, a scanning line drive circuit, a signal line drive circuit, and a common connection line drive circuit. The pixel array includes a plurality of scanning lines arranged in rows, a plurality of signal lines arranged in columns, a plurality of liquid crystal elements arranged in a matrix corresponding to an intersection of each scanning line and each signal line, and a plurality of common connection lines arranged one by one corresponding to the liquid crystal elements of each line. The scanning line drive circuit sequentially applies a selection pulse to the plurality of scanning lines, and sequentially selects the plurality of liquid crystal elements in a unit of the scanning line. The signal line drive circuit applies a signal potential corresponding to a video signal to each signal line, and writes the signal potential in the liquid crystal elements to be selected. The common connection line drive circuit electrically separates, from each other, one or a plurality of common connection lines (first common connection lines) arranged corresponding to the liquid crystal elements to be selected, and a plurality of common connection lines (second common connection lines) arranged corresponding to the liquid crystal elements not to be selected of lines different from a line including the liquid crystal elements to be selected, and at least two lines adjacent to each other, and electrically connects the plurality of second common connection lines to each other to independently drive the first common connection line and the second connection lines from each other.

According to an embodiment of the present invention, there is provided a method of driving a liquid crystal display device including the pixel array, the scanning line drive circuit, and the signal line drive circuit includes a step of electrically separating, from each other, one or a plurality of common connection lines (first common connection lines) arranged corresponding to the liquid crystal elements to be selected, and a plurality of common connection lines (second common connection lines) arranged corresponding to the liquid crystal elements not to be selected of lines different from a line including the liquid crystal elements to be selected, and at least two lines adjacent to each other, and electrically connecting the plurality of second common connection lines to each other to independently drive the first common connection line and the second connection lines from each other.

In the liquid crystal display device and the method of driving the liquid crystal display device according to the embodiments of the present invention, a common electrode for all the liquid crystal elements is not provided, but the common connection lines are provided one by one corresponding to the liquid crystal elements of each line. Thereby, in comparison with the case where the common electrode for all the liquid crystal elements is provided, it is possible to reduce capacity during driving. One or the plurality of first common connection lines and the plurality of second common connection lines are electrically separated from each other, and the plurality of second common connection lines are electrically connected to each other. Thereby, in the liquid crystal elements not to be selected, a potential difference is not generated between the second common connection lines during a period when a voltage applied to the corresponding liquid crystal elements is maintained. Moreover, since the first common connection line and the second common connection lines are independent from each other, influence from other wirings (for example, the scanning line, the signal line, a CS wiring, and a COM wiring) is small, and it is possible to realize high image quality.

Here, in the liquid crystal display device and the method of driving the liquid crystal display device according to the embodiments of the present invention, it is possible to employ various measures which will be described below. For example, the common connection line drive circuit may electrically separate, from each other, the first common connection line, and the common connection lines (second common connection lines) arranged corresponding to the liquid crystal elements not to be selected belonging to all the lines different from the line including the liquid crystal elements to be selected. Thereby, the influence form the liquid crystal elements not to be selected is hardly propagated to the liquid crystal elements to be selected. Moreover, in virtually all or in all the liquid crystal elements not to be selected, the potential difference is not generated between the second common connection lines during the period when the voltage applied to the corresponding liquid crystal elements is maintained.

According to the embodiments of the present invention, the common connection line drive circuit may allow the second common connection line to become floating for a predetermined time, and may apply a predetermined potential to the second connection line for a predetermined time. The liquid crystal elements selected by the one scanning line in the plurality of liquid crystal elements may be arranged in rows, or may be alternately arranged.

According to the liquid crystal display device and the method of driving the liquid crystal display device of the embodiments of the present invention, the capacity during driving is reduced, and the potential difference is not generated between the second common connection lines during the period when the voltage applied to the corresponding liquid crystal elements not to be selected is maintained. Thereby, it is possible to perform charge/discharge of the common connection line while suppressing power consumption and light leakage low.

In particular, in the case where the first common connection line, and the second common connection lines arranged corresponding to the liquid crystal elements not to be selected belonging to all the lines different from the line including the liquid crystal elements to be selected are electrically separated from each other, and the second common connection lines are electrically connected to each other, it is possible to extremely reduce the capacity during driving. Thereby, it is possible to not only further reduce the power consumption, but also virtually eliminate the light leakage. Since the common connection line of a write line is independent, the influence from the other wirings (for example, the scanning line, the signal line, the CS wiring, and the COM wiring) is small, and it is possible to realize the high image quality. Moreover, since it is possible to perform the charge/discharge of the common connection line at higher speed, it is possible to eliminate the risk that the deterioration of the image quality is generated due to the charge/discharge of the common connection line.

According to the embodiments of the present invention, in the case where the second common connections lines become floating for the predetermined time, and the predetermined potential is applied to the second common connection lines for the predetermined time, it is possible to reduce parasitic capacity of the plurality of signal lines arranged in columns and the second common connection lines. Thereby, the electric charge charged/discharged by the signal line is reduced, and it is possible to further suppress the power consumption low. In the case where the liquid crystal elements selected by the one scanning line in the plurality of liquid crystal elements are alternately arranged, and have a dot inversion structure, it is possible to suppress visibility of a flicker. Moreover, in one line corresponding to the one or the plurality of common connection lines arranged corresponding to the liquid crystal elements to be selected, the state of half the liquid crystal elements in the one line is active, and thus the capacity during driving becomes half As a result, it is possible to perform the charge/discharge of the common connection line at higher speed, and it is possible to apply the present invention to a large liquid crystal display and a landscape type liquid crystal display. That is, it is possible to improve the image quality by employing these measures.

Other and further objects, features and advantages of the invention will appear more fully from the following description.

DETAILED DESCRIPTION OF THE PREFERRED EMBODIMENT

Embodiments of the present invention will be hereinafter described in detail with reference to the drawings. The description will be made in the following order:

1. First embodiment (FIGS. 1 to 7)
   Case where pixels connected to one scanning line are alternately arranged
2. Modifications of the first embodiment (FIGS. 8 to 11)
   Variation of a common connection line drive circuit
3. Second embodiment (FIGS. 12 to 18)
   Case where the pixels connected to the one scanning line are arranged in lines.

1. First Embodiment (Schematic Configuration)

Figure 1:
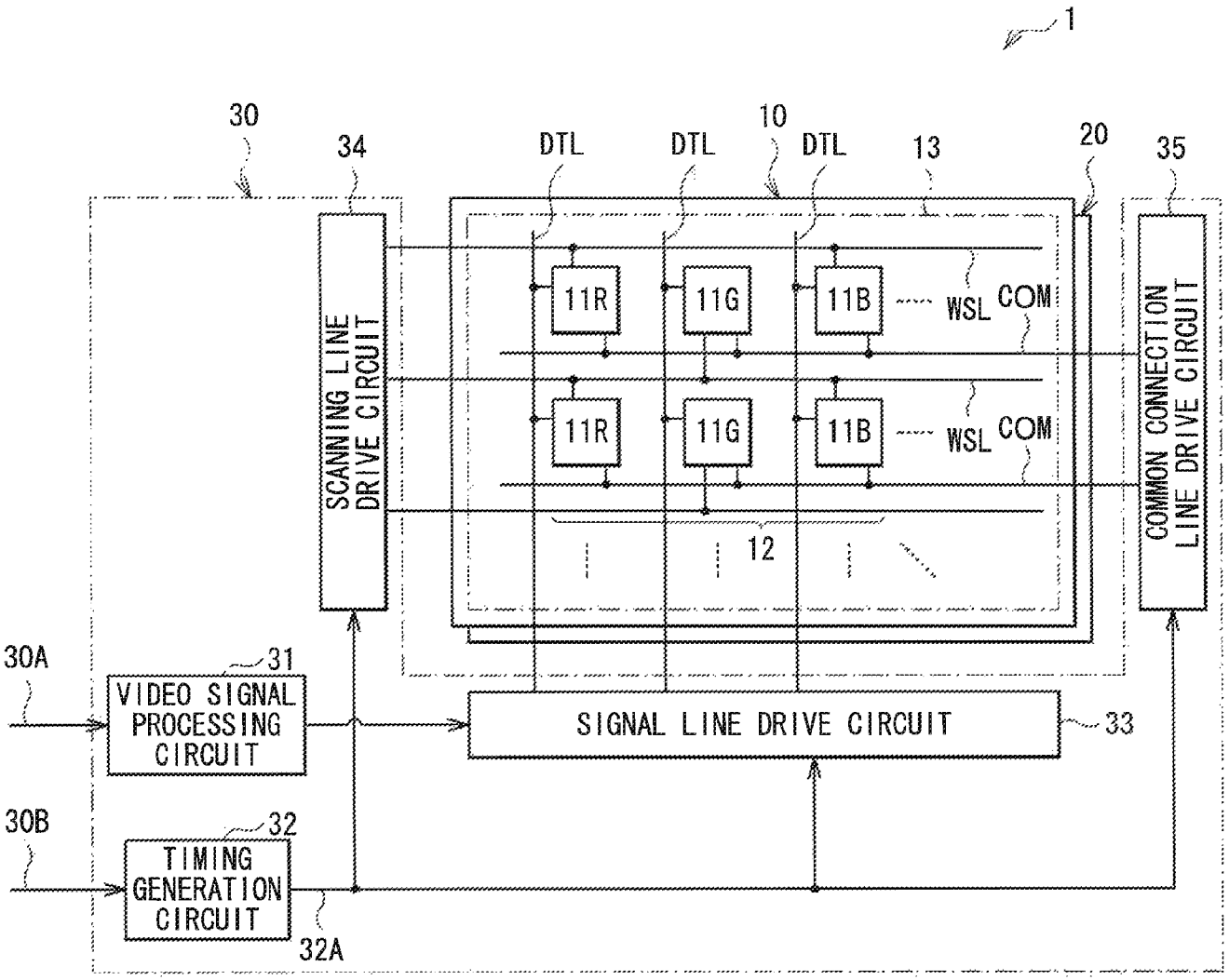
FIG. 1 is a schematic configuration view of a liquid crystal display device according to a first embodiment of the present invention.

FIG. 1 illustrates the schematic configuration of a liquid crystal display device 1 according to a first embodiment of the present invention. The liquid crystal display device 1 includes a liquid crystal display panel 10, a backlight 20 arranged in rear of the liquid crystal display panel 10, and a drive circuit 30 driving the liquid crystal display panel 10. The liquid crystal display panel 10 includes, for example, a pixel array 13 in which a plurality of sub-pixels 11R, 11G, and 11B are arranged in a matrix. In this embodiment, for example, the sub-pixels 11R, 11G, and 11B adjacent to each other constitute a pixel 12. Hereinafter, the term "sub-pixel 11" will be appropriately used as a general term for the sub-pixels 11R, 11G, and 11B. The drive circuit 30 includes, for example, a video signal processing circuit 31, a timing generating circuit 32, a signal line drive circuit 33, a scanning line drive circuit 34, and a common connection line drive circuit 35.

(Pixel Array 13)

Figure 2:
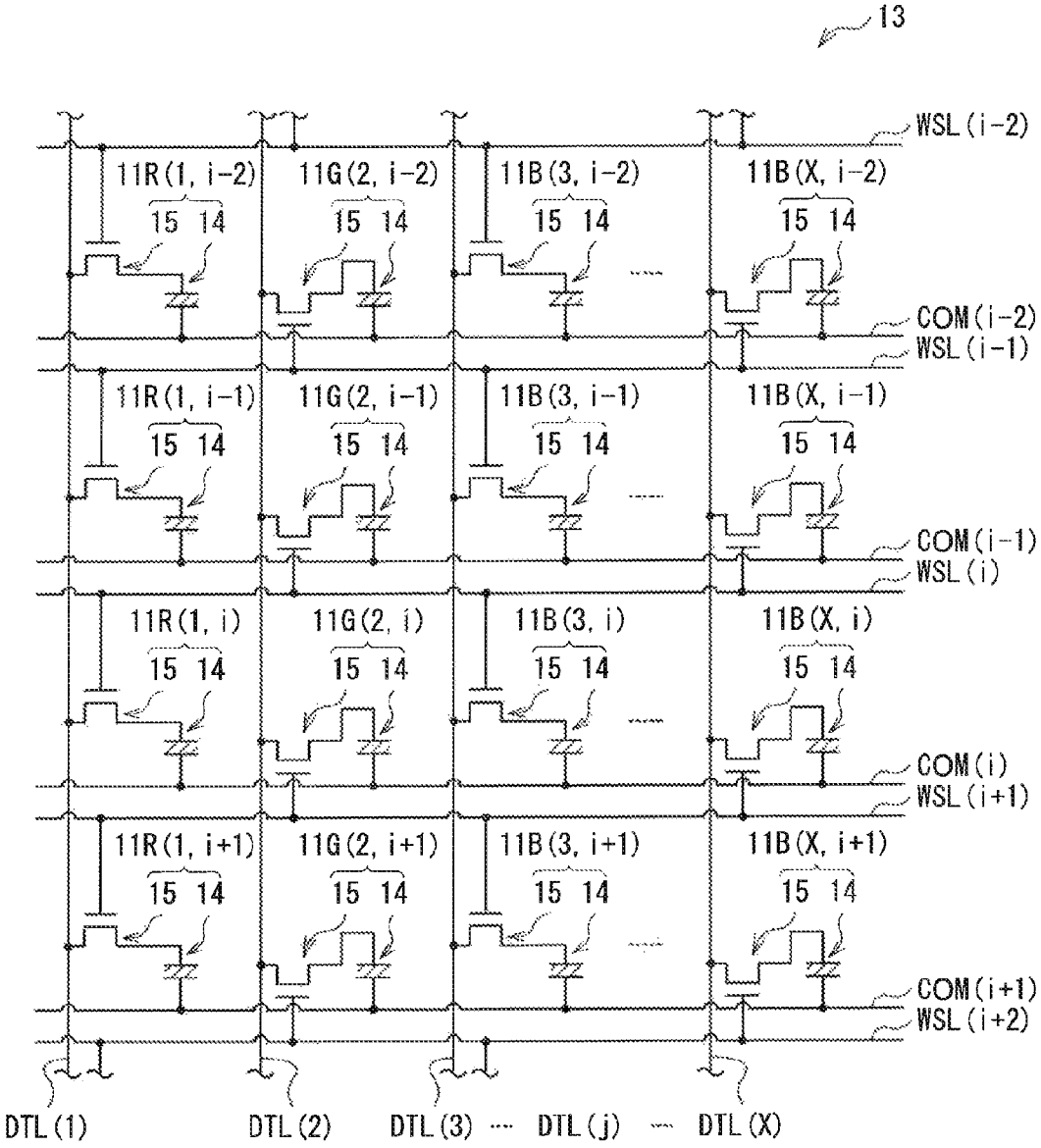
FIG. 2 is a configuration view of a pixel array of FIG. 1.

FIG. 2 illustrates an example of the circuit configuration in the pixel array 13. For example, as illustrated in FIGS. 1 and 2, the pixel array 13 includes a plurality of scanning lines WSL arranged in rows, and a plurality of signal lines DTL arranged in columns. The plurality of sub-pixels 11R, 11G, and 11B are arranged in a matrix corresponding to each intersection of each scanning line WSL and each signal line DTL. In the pixel array 13, a plurality of common connection lines COM are arranged one by one corresponding to the sub-pixels 11R, 11G, and 11B of each row.

In FIG. 2, to distinguish the individual scanning lines WSL and the individual common connection lines COM, (i) ($1 \leq i \leq Y$) is assigned to each end. Similarly, to distinguish the individual signal lines DTL, (j) ($1 \leq j \leq X$) is assigned to each end. To distinguish the individual sub-pixels 11R, 11G, and 11B, a coordinate (j, i) is assigned to each end.

As illustrated in FIG. 2, each of the sub-pixels 11 includes, for example, a liquid crystal element 14, and a transistor 15. The liquid crystal element 14 includes, for example, a common electrode, an insulating film, a pixel electrode, an alignment film, a liquid crystal layer, an alignment film, and a transparent substrate on a drive substrate in this order from the drive substrate side. In the drive substrate, for example, the transistor 15 or the like is formed on a glass substrate. The common electrode is a strip-shaped electrode provided for each horizontal line (one line), and is used in common for the liquid crystal elements 14 included in the plurality of sub-pixels 11 belonging to the one horizontal line. The common electrode constitutes, for example, a part of the common connection line COM, and is electrically connected to the common connection line COM. The insulating film insulates and separates the common electrode and the pixel electrode from each other, and provides a gap in the height direction between the common electrode and the pixel electrode. The liquid crystal layer is, for example, formed of liquid crystal of IPS (in-plane switching) mode, and has a function to transmit or shield the light emitted from the backlight 20 by the applied voltage. The pixel electrode functions as an electrode for each sub-pixel 11, and is, for example, arranged in a region not facing the common electrode. Thereby, when the voltage is applied between the pixel electrode and the common electrode, an electric field in the lateral direction is generated in the liquid crystal layer. The transistor 15 is, for example, a field-effect type TFT (thin film transistor), and is composed of a gate controlling a channel, and a source and a drain provided at both ends of the channel.

One end of the liquid crystal element 14 is connected to a source or a drain of the transistor 15, and the other end of the liquid crystal element 14 is connected to the common connection line COM. A gate of the transistor 15 is connected to the scanning line WSL, and one of the source and the drain of the transistor 15 which is not connected to the liquid crystal element 14 is connected to the signal line DTL. Here, in the plurality of sub-pixels 11 belonging to the one horizontal line, the gate of the transistor 15 is not connected to the common scanning line WSL, but alternately connected to the two scanning lines WSL provided at both sides of each sub-pixel 11. That is, the plurality of sub-pixels 11 connected to the one scanning line WSL are alternately (zigzag) arranged with the one scanning line WSL in between. Therefore, in the plurality of liquid crystal elements 14, the liquid crystal elements 14 selected by the one scanning line WSL are alternately arranged with the one scanning line WSL in between.

(Backlight 20)

The backlight 20 is intended to illuminate the liquid crystal display panel 10 from the rear side, and includes, for example, a light guide plate, a light source arranged on the side face of the light guide plate, and an optical element arranged on the top face (light emission face) of the light guide plate. The light guide plate is intended to guide the light from the light source to the top face of the light guide plate, and has, for example, a predetermined patterned shape at least on one of the top face and the bottom face. The light guide plate has a function to scatter and uniformize the light entering from the side face. The light source is a linear light source, and is formed of, for example, an HCFL (hot cathode fluorescent lamp), a CCFL, or a plurality of LEDs arranged in a line. The optical element is, for example, composed by stacking a diffusion plate, a diffusion sheet, a lens film, a polarization separation sheet, or the like.

(Drive Circuit 30)

Next, each circuit in the drive circuit 30 provided on the periphery of the pixel array 13 will be described with reference to FIG. 1.

The video signal processing circuit 31 corrects a digital video signal 30A input from the external, and converts the corrected video signal into an analogue signal to output the analogue signal to the signal line drive circuit 33. The timing generating circuit 32 controls the signal line drive circuit 33, the scanning line drive circuit 34, and the common connection line drive circuit 35 to operate in conjunction with each other. The timing generating circuit 32 outputs, for example, a control signal 32A to these circuit in response to (in synchronization with) a synchronization signal 30B input from the external.

Figure 3:
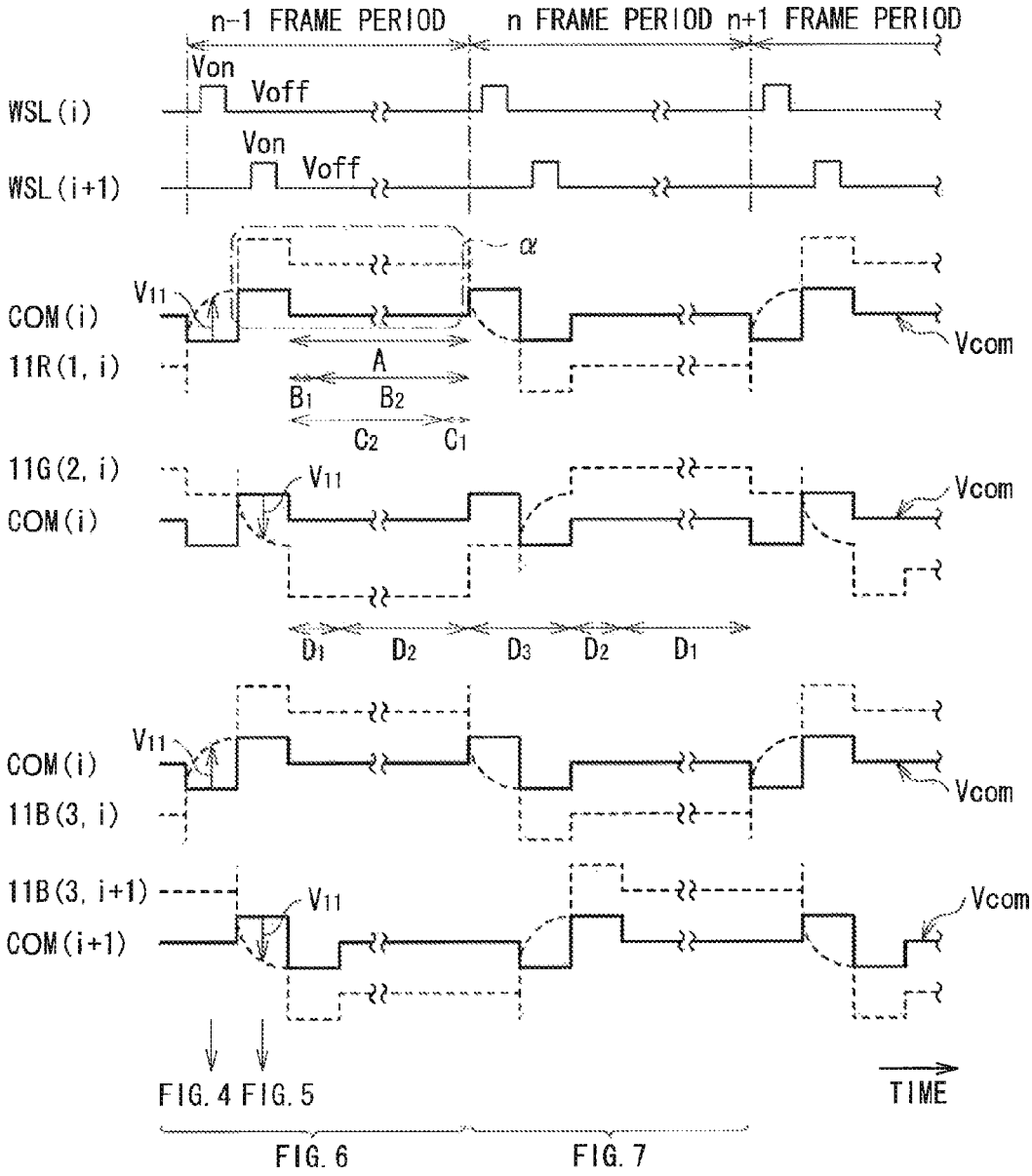
FIG. 3 is a waveform diagram illustrating an example of action of the liquid crystal display device of FIG. 1.
Figure 4:
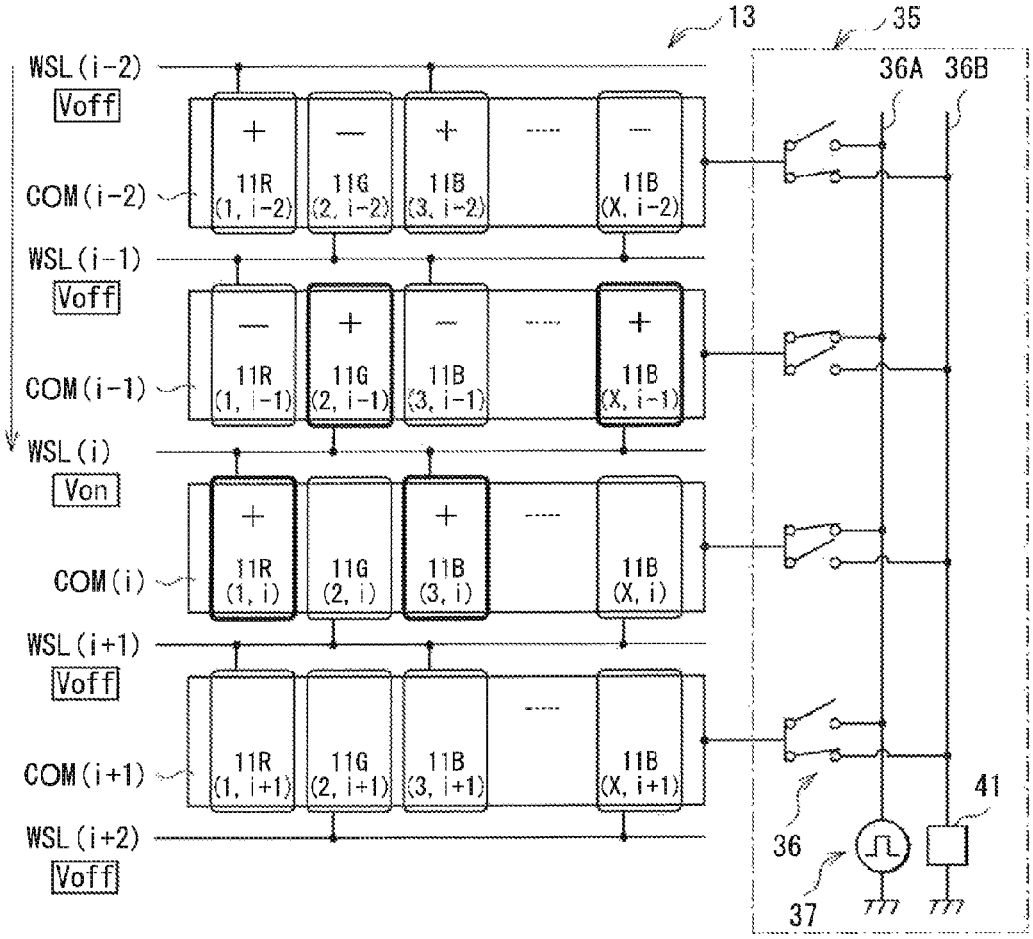
FIG. 4 is a schematic view schematically illustrating an example of the action of the liquid crystal display device of FIG. 1.
Figure 5:
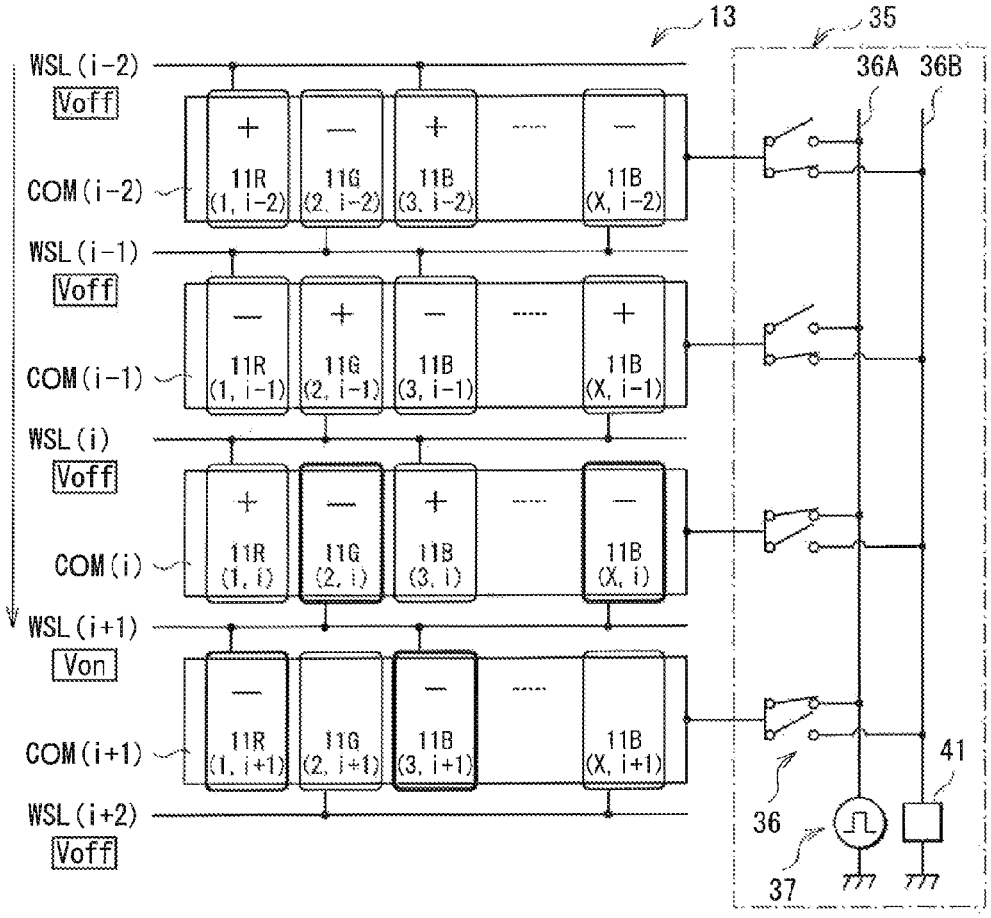
FIG. 5 is a schematic view schematically illustrating action subsequent to FIG. 4.
Figure 6:
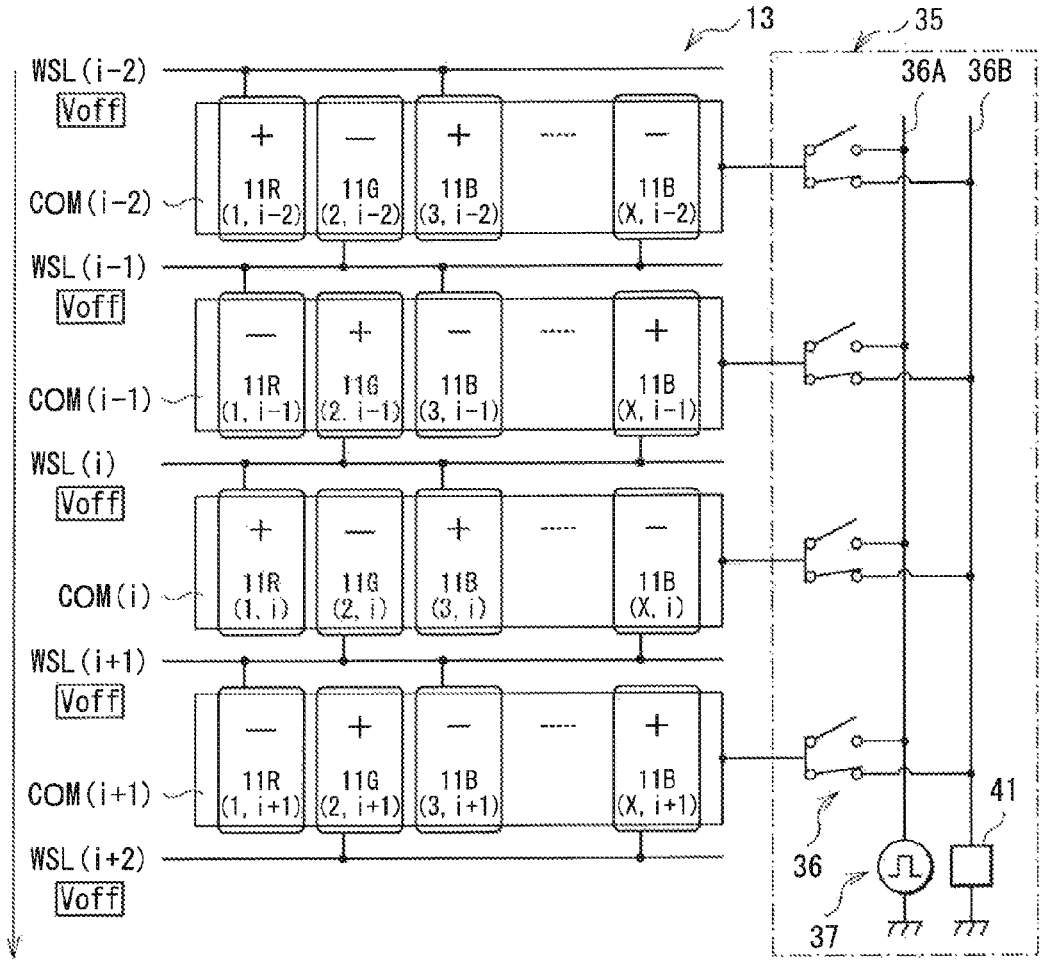
FIG. 6 is a schematic view schematically illustrating action subsequent to FIG. 5.
Figure 7:
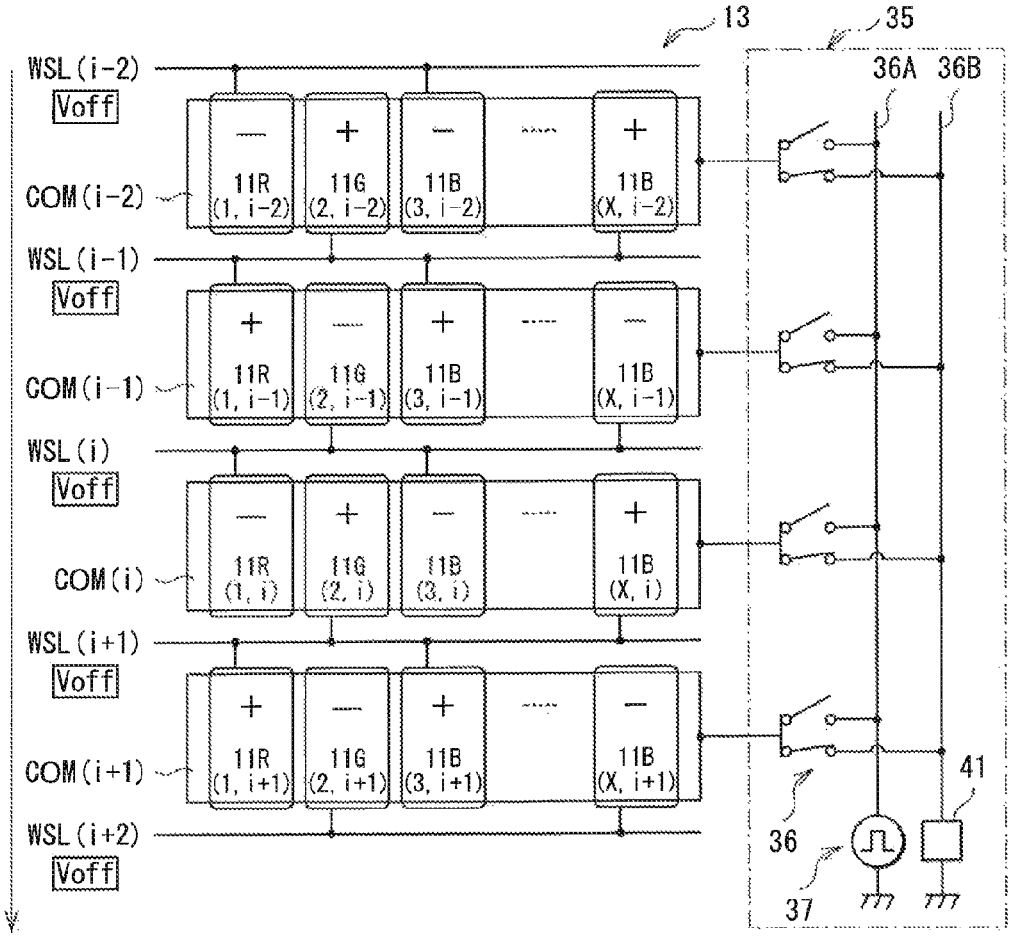
FIG. 7 is a schematic view schematically illustrating another example of the action of the liquid crystal display device of FIG. 1.

The signal line drive circuit 33 applies, to each signal line DTL, the analogue video signal (signal potential corresponding to the video signal 30A) input from the video signal processing circuit 31, and writes the analogue video signal in the sub-pixel 11 to be selected. The signal line drive circuit 33 may, for example, output a signal potential $V_{sig}$ corresponding to the video signal 30A. For example, as illustrated in FIGS. 3, 6, and 7 which will be described later, the signal line drive circuit 33 may perform a frame inversion drive. In the frame inversion drive, the signal potential $V_{sig}$ in which the potential is inverted to a reference potential $V_{ref}$ for each frame period is applied to each signal line DTL, and the signal potential $V_{sig}$ is written in the sub-pixel 11 to be selected. The frame inversion drive is intended to suppress deterioration of the liquid crystal element 14, and is used according to needs. For example, as illustrated in FIGS. 3 to 6 which will be described later, the signal line drive circuit 33 may perform a 1H inversion drive. In the 1H inversion drive, the signal potential $V_{sig}$ in which the potential is inverted to the reference potential $V_{ref}$ for each 1H period is applied to each signal line DTL, and the signal potential $V_{sig}$ is written in the sub-pixel 11 to be selected. The 1H inversion drive is intended to suppress generation of a flicker in each frame caused by the polarity inversion of the voltage applied to the liquid crystal element 14, and is used according to needs. Here the reference potential $V_{ref}$ is, for example, 0 (zero) bolt, or a potential $V_{com}$ of the common connection line COM.

The scanning line drive circuit 34 sequentially applies a selection pulse to the plurality of scanning lines in response to (in synchronization with) the input of the control signal 32A, and sequentially selects the plurality of sub-pixels in a unit of the scanning line WSL. The scanning line drive circuit 24 may, for example, output a voltage $V_{on}$ applied when turning on the transistor 15, and a voltage $V_{off}$ applied when turning off the transistor 15. Here, the voltage $V_{on}$ has a value (constant value) equal to or higher than that of an on-voltage of the transistor 15. The voltage $V_{off}$ has a value (constant value) lower than that of the on-voltage of the transistor 15.

Next, the common connection line drive circuit 35 will be described. FIG. 3 is a timing chart illustrating an example of the action of the liquid crystal display device 1. In FIG. 3, the waveform in an $n-1^{th}$ frame period, an $n^{th}$ frame period, and an $n+1^{th}$ frame period is illustrated. FIG. 4 schematically illustrates the polarity of the sub-pixel 11 at the timing of the application of the $V_{on}$ to the scanning line WSL (i) in the $n-1^{th}$ frame period of FIG. 3. FIG. 5 schematically illustrates the polarity of the sub-pixel 11 at the timing of the application of the $V_{on}$ to the scanning line WSL (i+1) in the $n-1^{th}$ frame period of FIG. 3. FIG. 6 schematically illustrates the polarity of the sub-pixel 11 when the $n-1^{th}$ frame period of FIG. 3 is passed. FIG. 7 schematically illustrates the polarity of the sub-pixel 11 when the $n^{th}$ frame period of FIG. 3 is passed. In FIGS. 4 to 7, the polarity of the sub-pixel 11 in the case where the signal line drive circuit 33 performs the 1H inversion drive and the frame inversion drive is illustrated. In addition, in FIGS. 4 and 5, the sub-pixel 11 surrounded by the thick line denotes that the sub-pixel 11 is selected by the scanning line WSL (i) or the scanning line WSL (i+1). In FIGS. 4 to 7, the sub-pixel 11 surrounded by the narrow line denotes that the selection by the scanning line is finished already, and it is in a retention period. In FIGS. 4 and 5, the sub-pixel 11 surrounded by the dotted line denotes that the selection by the scanning lines is not performed yet.

Here, the expression "polarity of the sub-pixel 11" denotes whether a potential $V_{11}$ of the sub-pixel 11 (refer to FIG. 3) is positive or negative in relation to the potential $V_{com}$ of the common connection line COM. For example, as illustrated in FIG. 3, when the $V_{on}$ is applied to the scanning line WSL (i), the potential $V_{11}$ of the sub-pixel 11R (1, i) is a positive potential in relation to the potential $V_{com}$. Therefore, in this case, it may be said that the sub-pixel 11R (1, i) has a positive polarity. Meanwhile, for example, when the $V_{on}$ is applied to the scanning line WSL (i+1), the potential $V_{11}$ applied to the sub-pixel 11G (2, i) is a negative potential in relation to the potential V. Therefore, in this case, it may be said that the sub-pixel 11G (2, i) has a negative polarity.

As illustrated in FIGS. 3 to 6, when the signal line drive circuit 33 performs the 1H inversion drive, the common connection line drive circuit 35 performs the common inversion drive in which the polarity of the voltage supplied to the common electrode (common connection line COM) is inverted for each predetermined horizontal line. Specifically, the common connection line drive circuit 35 may apply, to the common connection line COM corresponding to the sub-pixel 11 to be selected, the potential whose polarity to the reference potential $V_{ref}$ is opposite to the polarity to the reference potential $V_{ref}$ in the signal line DTL. As illustrated in FIG. 4, the common connection line drive circuit 35 includes, for example, a switching element 36 electrically connected to the common connection line COM. The switching element 36 is provided one by one for each of the common connection lines COM, and includes, for example, two output terminals. One output terminal of the switching element 36 is connected to a wiring 36A, and then connected to an output terminal of an auxiliary pulse generating device 37 through the wiring 36A. The other output terminal of the switching element 36 is connected to a wiring 36B. As illustrated in FIG. 4, the wiring 36B is, for example, connected to an output terminal of a logic circuit 41. The logic circuit 41 outputs, for example, a signal of 2.5 V which is larger than 0 V.

The common connection line drive circuit 35 connects the common connection lines COM (first common connection lines) to the output terminal of the auxiliary pulse generating device 37, the common connection lines COM being arranged correspondingly to the horizontal lines including the sub-pixels 11 (to be selected) turned on by applying the $V_{on}$ to the scanning line WSL. For example, as illustrated in FIG. 4, the common connection line drive circuit 35 connects the common connection lines COM (i−1) and COM (i) to the output of the auxiliary pulse generating device 37 through the switching element 36 and the wiring 36A, the common connection lines COM (i−1) and COM (i) being arranged corresponding to the two lines including the sub-pixels 11R (1, i), 11G (2, i−1), 11B (3, i) . . . , and 11B (X, i−1) to be selected.

The common connection line drive circuit 35 connects the common connection lines COM (second common connection lines) to the wiring 36B for a predetermined time, the common connection lines COM being arranged corresponding to at least the two horizontal lines adjacent to each other in the plurality of horizontal lines including only the sub-pixels 11 (not to be selected) which are turned off by applying the voltage $V_{off}$ to the scanning line WSL. For example, as illustrated in FIG. 4, the common connection line drive circuit 35 connects the common connection lines COM (i−2) and COM (i−3) to the wiring 36B through the switching element 36, the common connection lines COM (i−2) and COM (i−3) being arranged corresponding to the two lines including the sub-pixels 11R (1, i−2), 11R (1, i−3), and the like not to be selected.

Here, as indicated by α of FIG. 3, when the sub-pixel 11 is not selected, the potential $V_{11}$ of the sub-pixel 11 maintains the potential applied to the sub-pixel 11 when being selected. That is, in either case whether the common connection line COM (i) is connected to the wiring 36A or the wiring 36B, the potential $V_{11}$ of the sub-pixel 11 is not changed, and only the potential of the common connection line COM (i) is changed. Accordingly, the display luminance of the sub-pixel 11 is constant all the time when the pixel 11 is not selected.

In addition, for example, the second common connection line may be connected to the wiring 36A only in the beginning of the period indicated by A of FIG. 3 (for example, only in the period of B1 of FIG. 3), and the second common connection line may be connected to the wiring 36B in the remainder of the period indicated by A of FIG. 3 (for example, in the period of B2 of FIG. 3). For example, the second common connection line may be connected to the wiring 36A only in the end of the period indicated by A of FIG. 3 (for example, only in the period of C1 of FIG. 3), and the second common connection line may be connected to the wiring 36B in the remainder of the period indicated by A of FIG. 3 (for example, in the period of C2 of FIG. 3). For example, the second common connection line may be connected to the wiring 36A only in the period (for example, in the period of D2 of FIG. 3) obtained by subtracting the period when the auxiliary pulse is output to the second common connection line from the period corresponding to the one frame period interposing the period (for example, the period of D3 of FIG. 3) when the auxiliary pulse is output from the auxiliary pulse generating device 37 to the second common connection line, and the second common connection line may be connected to the wiring 36B in the period (for example, in the period of D1 of FIG. 3) before and after that period.

In this embodiment, the common connection line drive circuit 35 electrically separates, from each other, the two common connection lines COM (first common connection lines) arranged corresponding to the sub-pixels 11 to be selected, and the plurality of common connection lines COM (second common connection lines) arranged corresponding to the sub-pixels 11 not to be selected of the horizontal lines different from the horizontal lines including the sub-pixels 11 to be selected, and at least the two horizontal lines adjacent to each other. For example, as illustrated in FIG. 5, the common connection line drive circuit 35 electrically separates, from each other, the two common connection lines COM (i) and COM (i+1) arranged corresponding to the sub-pixels (11R (1, i+1), 11G (2, i), 11B (3, i+1), and 11B (X, i) to be selected, and the two common connection lines COM (i−2) and COM (i−1) arranged corresponding to the two horizontal lines including the sub-pixels 11R (1, i−2) and 11R (1, i−1) not to be selected.

Moreover, in this embodiment, the common connection line drive circuit 35 electrically connects the plurality of second common connection lines to each other, and independently drives the first common connection lines and the second common connection lines from each other. For example, as illustrated in FIG. 5, the common connection line drive circuit 35 connects the two common connection lines COM (i−2) and COM (i−1) to each other, and independently drives the two common connection lines COM (i) and COM (i+1), and the two common connection lines COM (i−2) and COM (i−1) from each other.

Thereby, in comparison with the case where the common electrode for all the sub-pixels 11 is provided, it is possible to reduce the capacity during driving. In the sub-pixels 11 not to be selected, the potential difference is not generated between the second common connection lines during the period when the potential applied to the corresponding sub-pixels 11 is maintained. Thereby, it is possible to perform the charge/discharge of the common connection line COM at high speed while suppressing both the power consumption and the light leakage low.

The potential of the first common connection line and the potential of the second common connection line are preferably not highly different. For example, the potential of the first common connection line may be 5 V, and the potential of the second common connection line may be 2.5 V which is larger than 0 V. In this case, since the large electric field in the lateral direction is not generated between the first common connection line and the second common connection line, it is possible to reduce the light leakage in this part.

In this embodiment, the common connection line drive circuit 35 preferably electrically separates, from each other, the first common connection lines, and the common connection lines COM (third common connection lines) arranged corresponding to the sub-pixels 11 not to be selected belonging to all the horizontal lines different from the horizontal lines including the sub-pixels 11 to be selected. For example, although not illustrated in the figure, the common connection line drive circuit 35 preferably electrically separates, from each other, the two common connection lines COM (i) and COM (i+1) arranged corresponding to the sub-pixels 11R (1, i+1), 11G (2, i), 11B (3, i+1), and 11B (X, i) to be selected, and the common connection lines COM (1) to COM (i−1), and COM (i+2) to COM (Y) arranged corresponding to all the horizontal lines including the sub-pixel 11R (1, i−2), 11R (1, i−1), and the like not to be selected. At this time, the common connection line drive circuit 35 connects the third common connection lines to the wiring 36B for the predetermined time.

Thereby, the influence from the sub-pixel 11 not to be selected is hardly propagated to the sub-pixel 11 to be selected. Moreover, in virtually all or in all the sub-pixels 11 not to be selected, the potential difference is not generated between the third common connection lines during the period when the voltage applied to the corresponding sub-pixels 11 is maintained. As a result, it is possible not only to further reduce the power consumption, but also virtually eliminate the light leakage. Moreover, since the charge/discharge of the common connection line COM may be performed at higher speed, it is possible to eliminate the risk that the deterioration of the image quality is generated due to the charge/discharge of the common connection line COM.

As illustrated in FIGS. 6 and 7, in this embodiment, when the signal line drive circuit 33 performs the frame inversion drive, the common connection line drive circuit 35 performs the common inversion drive in which the polarity of the voltage supplied to the common electrode (common connection line COM) is inverted for each frame period. For example, as illustrated in FIGS. 6 and 7, the common connection line drive circuit 35 inverts the polarity of the voltage applied to the sub-pixel 11 for each frame period so that the polarity of the sub-pixel 11 when the $n-1^{th}$ frame period is passed, and the polarity of the sub-pixel 11 when the $n^{th}$ frame period is passed are opposite from each other. Thereby, it is possible to reduce the amplitude of the signal voltage applied to the sub-pixel 11, and it is possible to further suppress the power consumption low.

In this embodiment, in the case where the common connection line drive circuit 35 allows the second common connection line or the third common connection line to become floating for the predetermine time, the wiring capacity of the signal line DTL and the common connection line COM is drastically reduced, and thus it is possible to further suppress the power consumption low. In this embodiment, in the case where the common connection line drive circuit 35 allows the second common connection line or the third common connection line to have a predetermined potential (for example, 2.5 V which is larger than 0 V) for the predetermined time, the signal line DTL hardly receives the coupling influence from the common connection line COM, and thus it is possible to further suppress the power consumption low.

In this embodiment, in the case where the sub-pixels 11 selected by the one scanning line in the plurality of sub-pixels 11 are alternately arranged, and have a dot inversion structure, it is possible to suppress visibility of a flicker. In one line corresponding to the one or the plurality of common connection lines arranged corresponding to the sub-pixels 11 to be selected, the state of half the sub-pixels 11 in the one line is active, and thus the capacity during driving becomes half. As a result, it is possible to perform the charge/discharge of the common connection line at higher speed, and it is possible to apply the liquid crystal display device 1 of this embodiment to a large liquid crystal display and a landscape type liquid crystal display.

2. Modification

Figure 8:
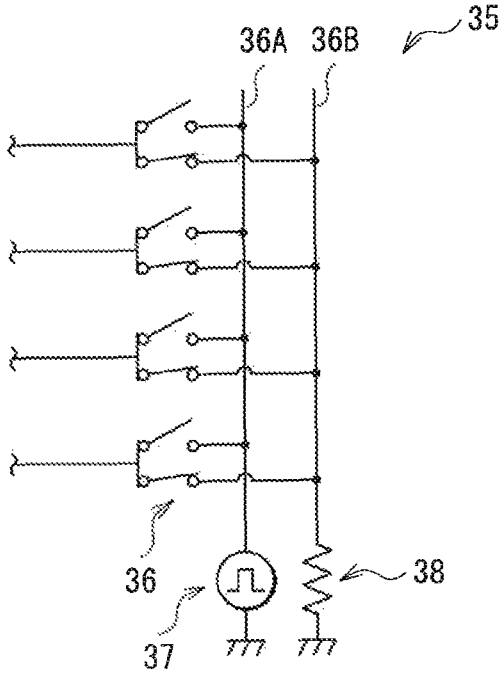
FIG. 8 is a configuration view illustrating a first modification of a common connection line drive circuit of FIG. 1.

In the above embodiment, for example, as illustrated in FIG. 8, a resistance 38 may be conned to the end of the wiring 36B. Even in this case, when the resistance 38 is extremely highly-resistive, it is possible to practically regard the wiring 36B as being floating.

Figure 9:
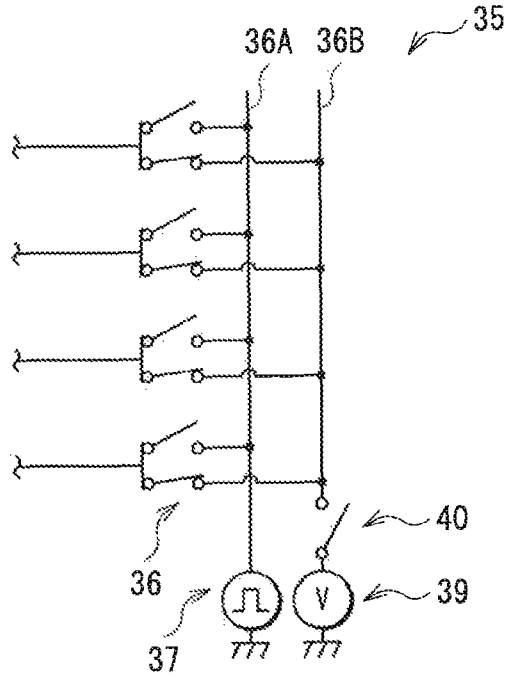
FIG. 9 is a configuration view illustrating a second modification of the common connection line drive circuit of FIG. 1.

For example, as illustrated in FIG. 9, an output terminal of a constant voltage source 39 may be connected to the end of the wiring 36B through a switching element 40. In this case, the potential of the wiring 36B is stabilized, and thus it is possible to reduce malfunction when the liquid crystal display device 1 of this modification is used in a device sensitive to noise (for example, a touch panel) or the like.

Figure 10:
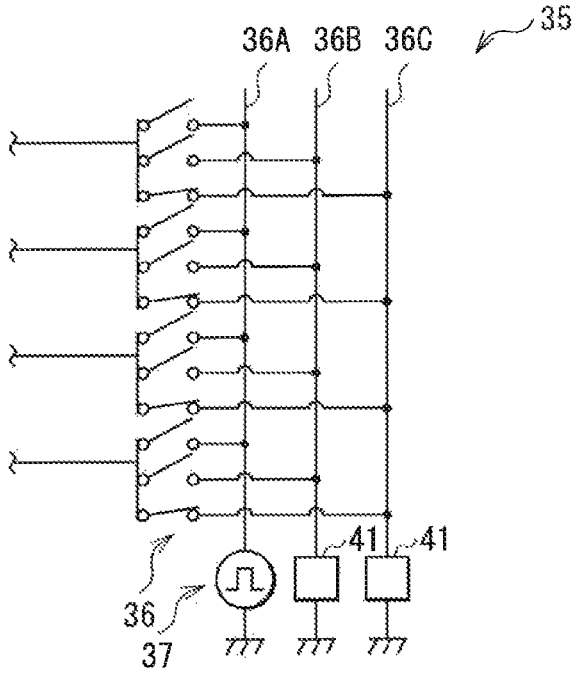
FIG. 10 is a configuration view illustrating a third modification of the common connection line drive circuit of FIG. 1.
Figure 11:
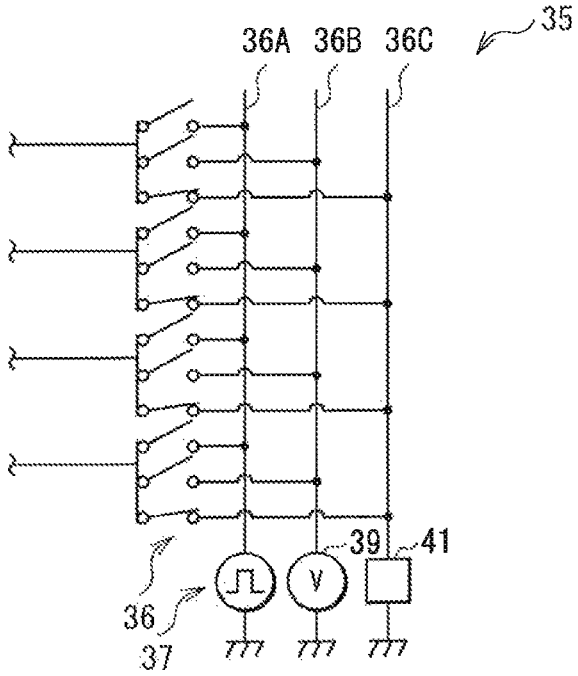
FIG. 11 is a configuration view illustrating a fourth modification of the common connection line drive circuit of FIG. 1.

For example, as illustrated in FIGS. 10 and 11, the number of the output terminals of the switching element 36 may be three. In this case, it is possible to use the output of the logic circuit 41 and the output of the constant voltage source 39 when the sub-pixel 11 is not selected, and thus it is possible to realize flexibility of the design.

3. Second Embodiment

Figure 12:
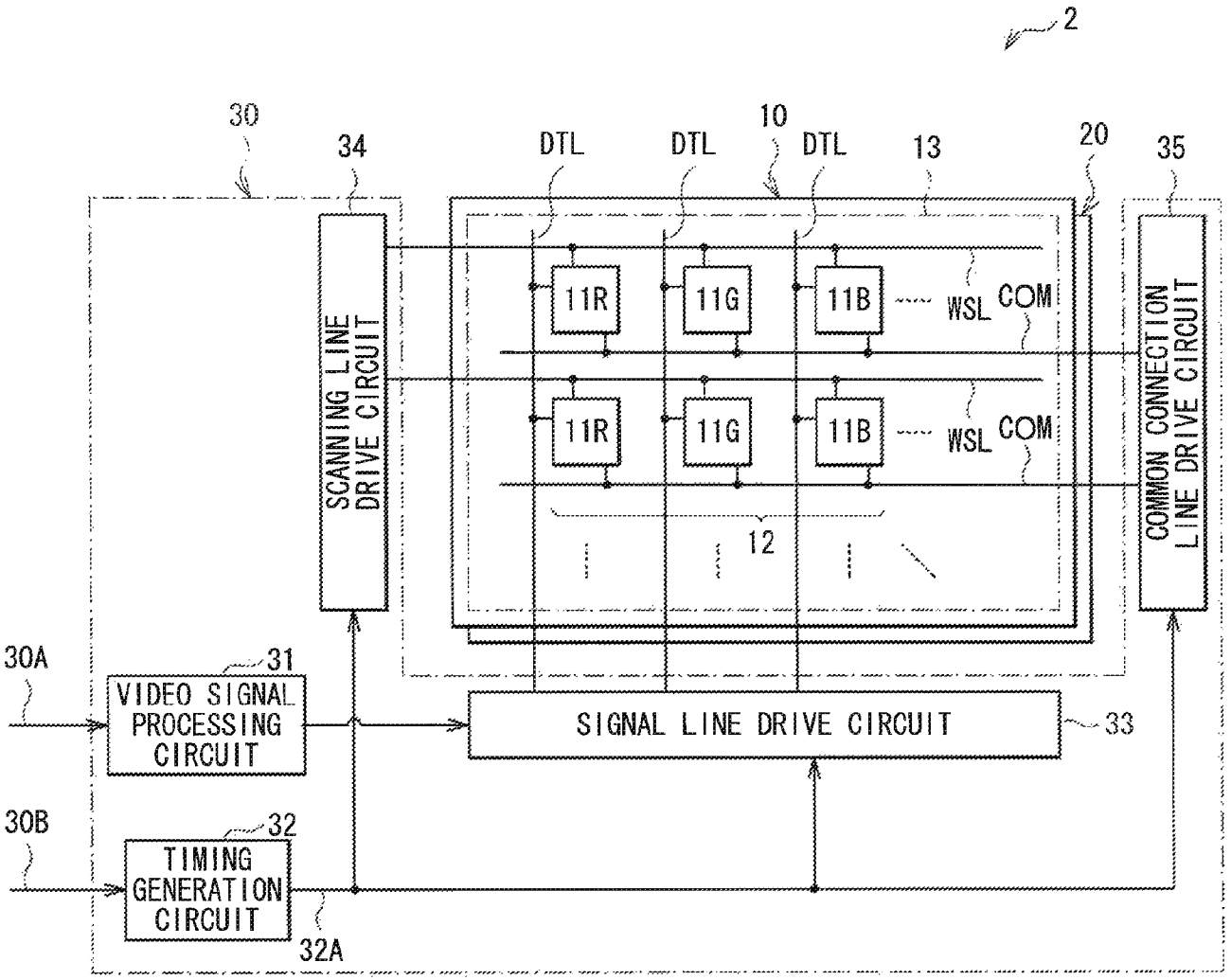
FIG. 12 is a schematic configuration view of the liquid crystal display device according to a second embodiment of the present invention.
Figure 13:
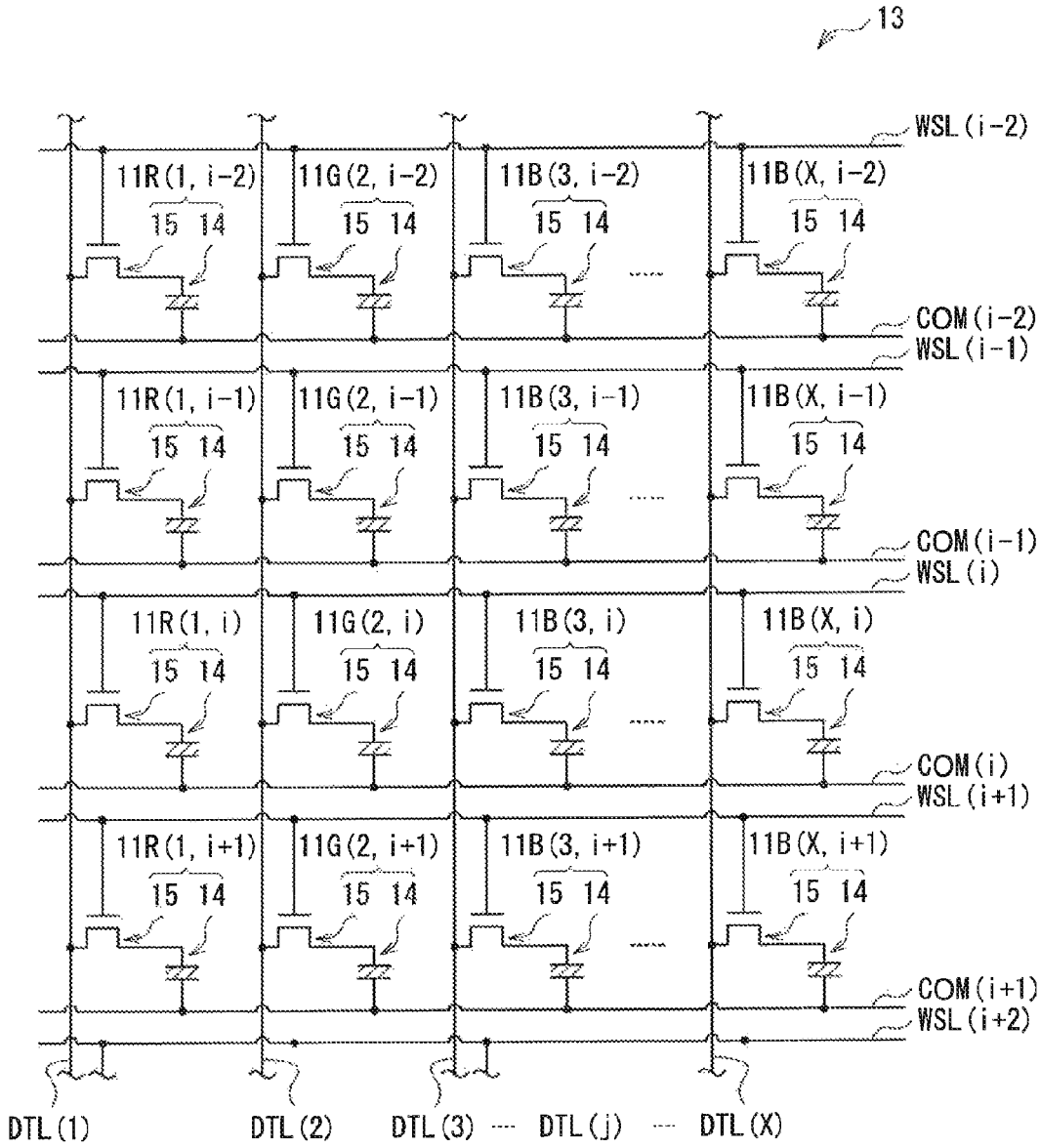
FIG. 13 is a configuration view of the pixel array of FIG. 12.

FIG. 12 illustrates the schematic configuration of a liquid crystal display device 2 according to a second embodiment of the present invention. FIG. 13 illustrates an example of the internal configuration of the pixel array 13 of the liquid crystal display device 2 of FIG. 12. The configuration of the liquid crystal display device 2 differs from the configuration of the liquid crystal display device 1 of the above embodiment in that the plurality of sub-pixels 11 connected to the one scanning line WSL are arranged in a line (in a row). Hereinafter, the description common to the above embodiment is omitted, and the difference from the above embodiment will be mainly described.

Figure 14:
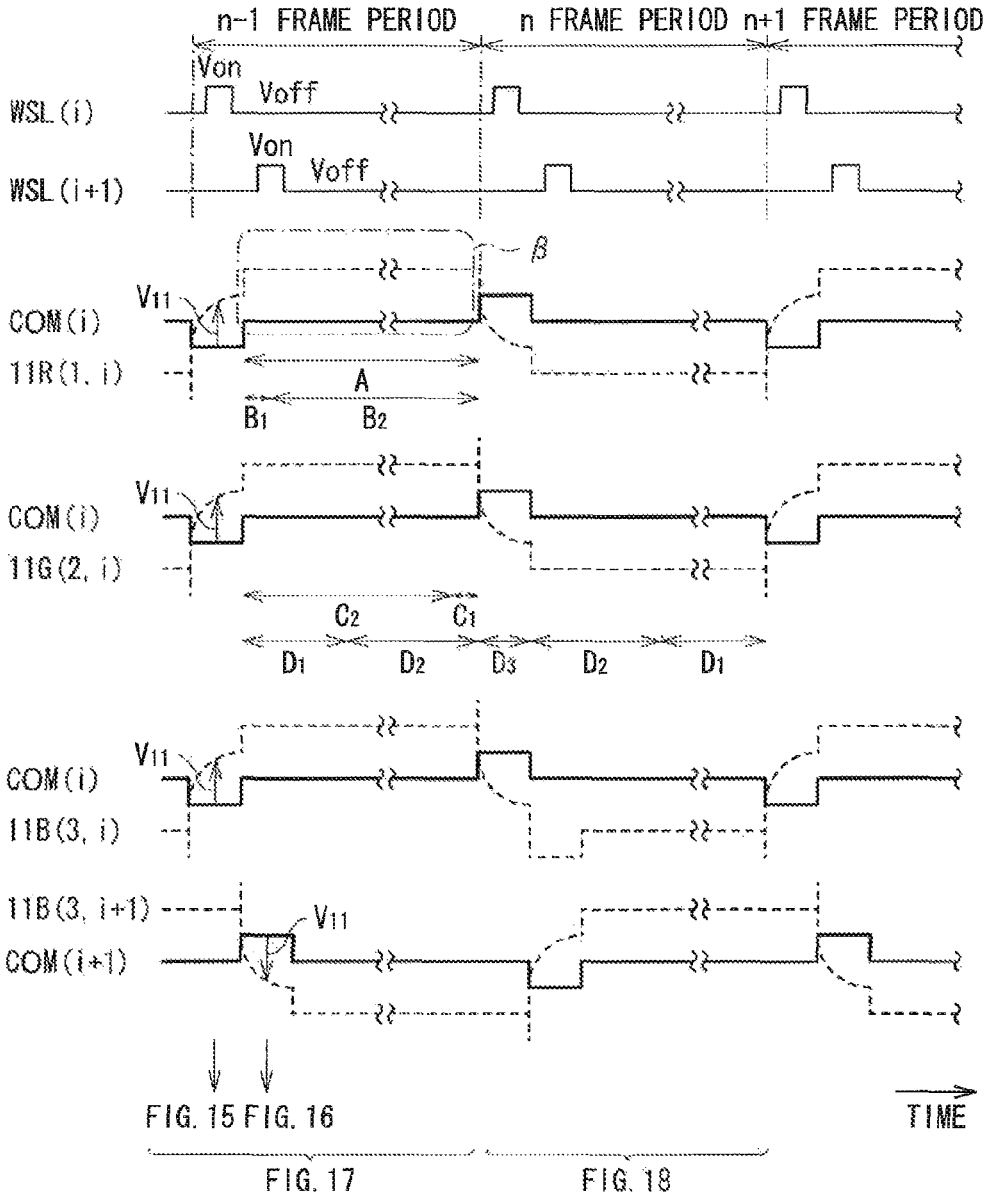
FIG. 14 is a waveform diagram illustrating an example of the action of the liquid crystal display device of FIG. 12.
Figure 15:
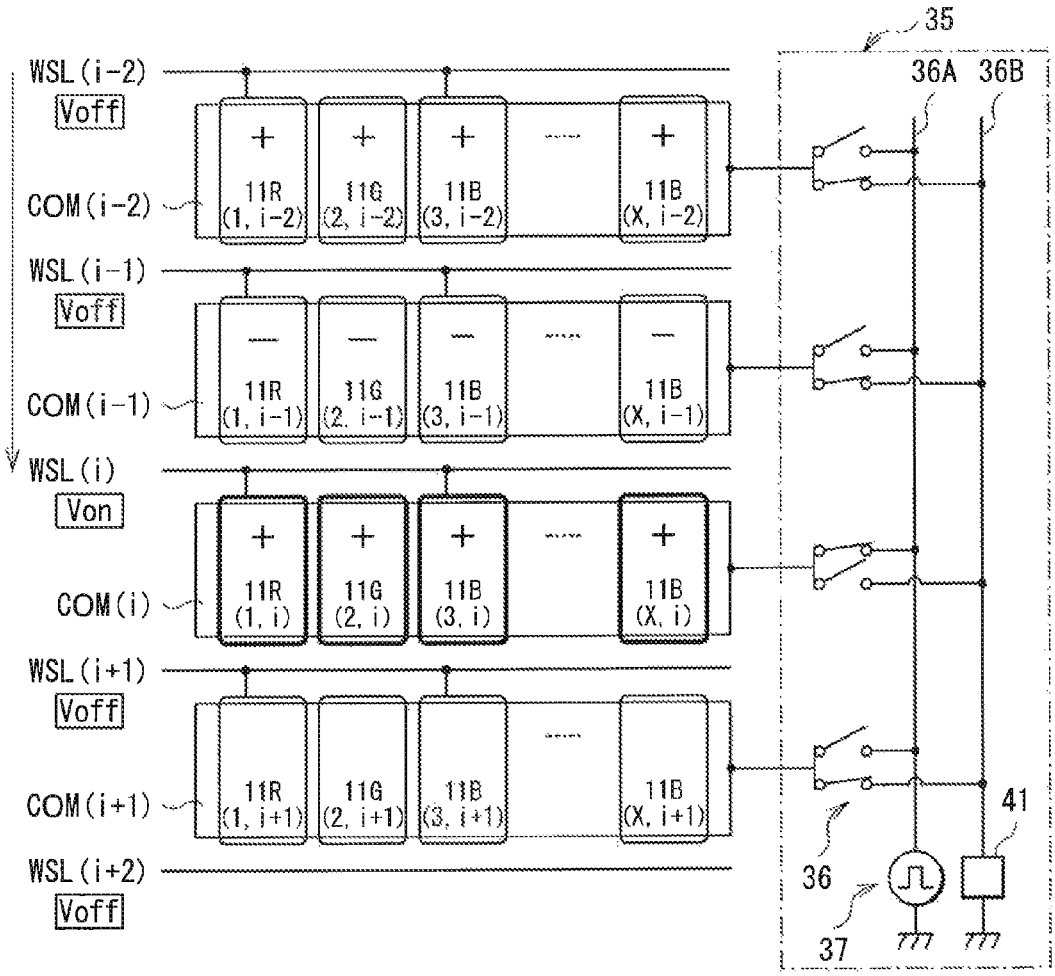
FIG. 15 is a schematic view schematically illustrating an example of the action of the liquid crystal display device of FIG. 12.
Figure 16:
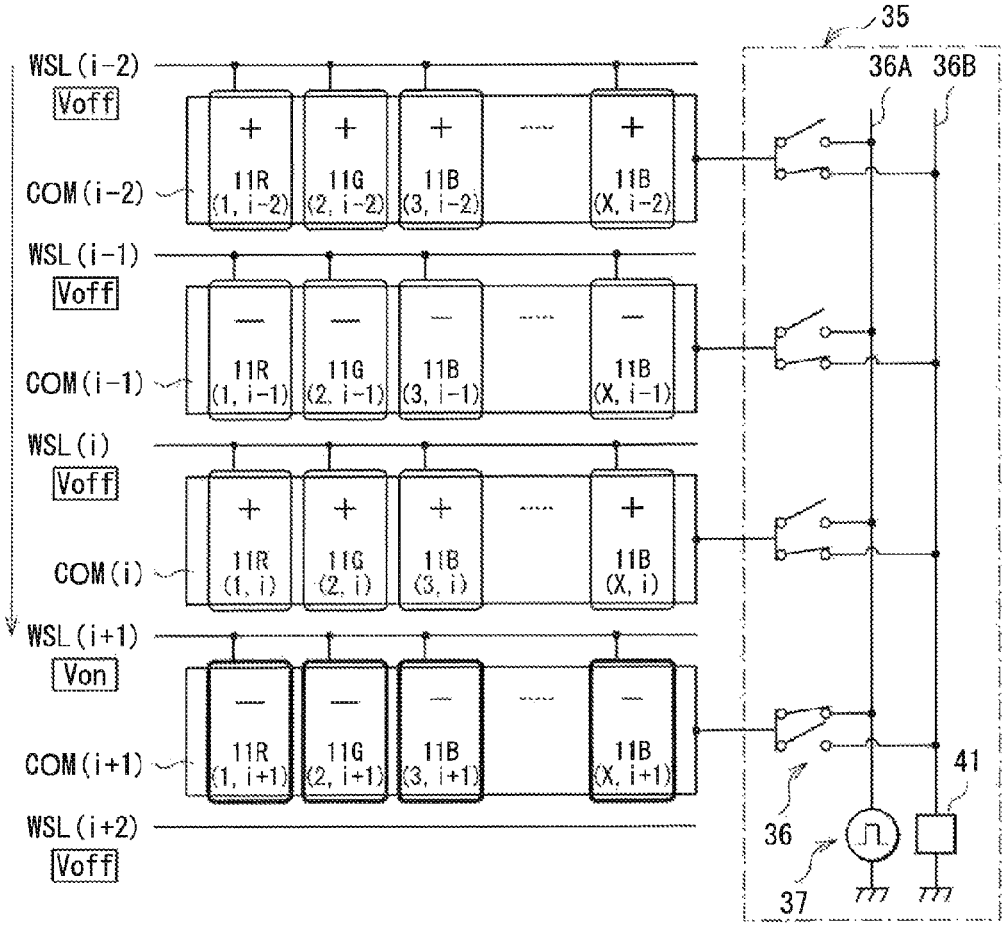
FIG. 16 is a schematic view schematically illustrating action subsequent to FIG. 15.
Figure 17:
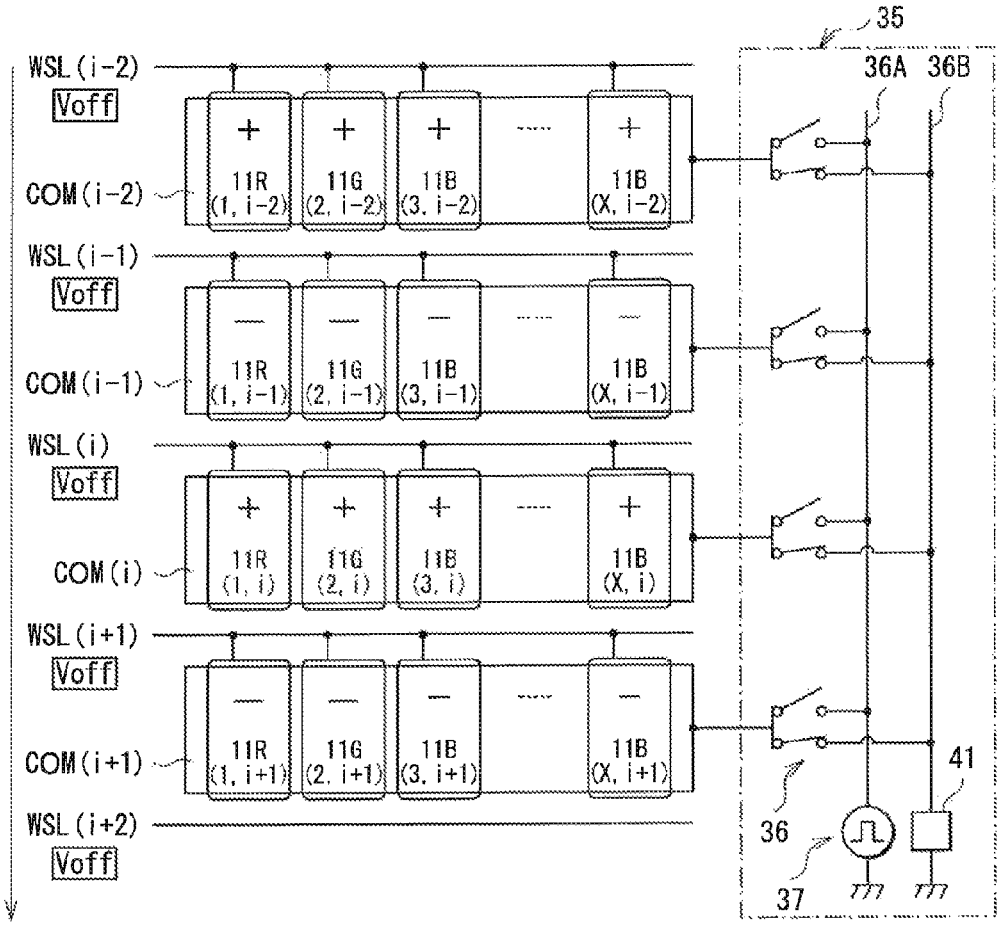
FIG. 17 is a schematic view schematically illustrating action subsequent to FIG. 15.
Figure 18:
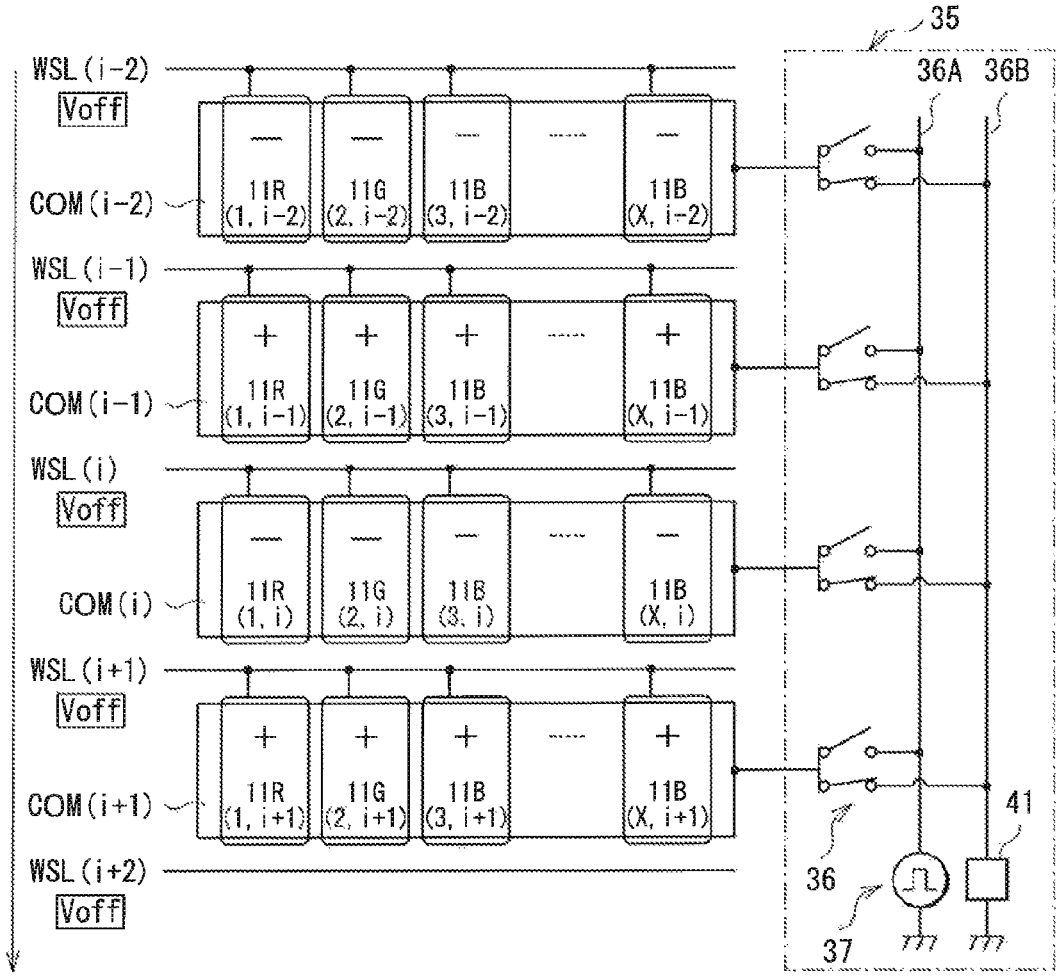
FIG. 18 is a schematic view schematically illustrating another example of the action of the liquid crystal display device of FIG. 12.

FIG. 14 is a timing chart illustrating an example of action of the liquid crystal display device 2. In FIG. 14, the waveform in the $n-1^{th}$ frame period, the $n^{th}$ frame period, and the $n+1^{th}$ frame period is illustrated. FIG. 15 schematically illustrates the polarity of the sub-pixel 11 at the timing of the application of the $V_{on}$ to the scanning line WSL (i) in the $n-1^{th}$ frame period of FIG. 14. FIG. 16 schematically illustrates the polarity of the sub-pixel 11 at the timing of the application of the $V_{on}$ to the scanning line WSL (i+1) in the $n-1^{th}$ frame period of FIG. 14. FIG. 17 schematically illustrates the polarity of the sub-pixel 11 when the $n-1^{th}$ frame period of FIG. 14 is passed. FIG. 18 schematically illustrates the polarity of the sub-pixel 11 when the $n^{th}$ frame period of FIG. 14 is passed. In FIGS. 14 to 18, the polarity of the sub-pixel 11 in the case where the signal line drive circuit 33 performs the 1H inversion drive and the frame inversion drive is illustrated. In addition, in FIGS. 15 and 16, the sub-pixel 11 surrounded by the thick line denotes that the sub-pixel 11 is selected by the scanning line WSL (i) or the scanning line WSL (i+1). In FIGS. 15 to 18, the sub-pixel 11 surrounded by the narrow line denotes that the selection by the scanning line is finished already, and it is in the retention period. In FIG. 15, the sub-pixel 11 surrounded by the dotted line denotes that the selection by the scanning line is not performed yet.

As illustrated in FIGS. 14 to 17, when the signal line drive circuit 33 performs the 1H inversion drive, the common connection line drive circuit 35 of this embodiment performs the common inversion drive in which the polarity of the voltage supplied to the common electrode (common connection line COM) is inverted for each 1H.

The common connection line drive circuit 35 connects the common connection line COM (first common connection line) to the output of the auxiliary pulse generating device 37, the common connection line COM being arranged corresponding to the one horizontal line including the sub-pixels 11 (to be selected) which are turned on by applying the $V_{on}$ to the scanning line WSL. For example, as illustrated in FIG. 15, the common connection line drive circuit 35 connects the common connection line COM (i) to the output of the auxiliary pulse generating device 37 through the switching element 36 and the wiring 36A, the common connection line COM (i) being arranged corresponding to the one line including the sub-pixels 11R (1, i), 11G (2, i), 11B (3, i) . . . , and 11B (X, i) to be selected.

The common connection line drive circuit 35 connects the common connection lines COM (second common connection lines) to the wiring 36B for the predetermined time, the common connection lines COM being arranged corresponding to at least the two horizontal lines adjacent to each other in the plurality of horizontal lines including only the sub-pixels 11 (not to be selected) which are turned off by applying the voltage $V_{off}$ to the scanning line WSL. For example, as illustrated in FIG. 16, the common connection line drive circuit 35 connects the common connection lines COM (i) and COM (i−1) to the wiring 36B through the switching element 36, the common connection lines COM (i) and COM (i−1) being arranged corresponding to the two lines including the sub-pixels 11R (1, i), 11R (1, i−1), and the like not to be selected.

Here, as indicated by β of FIG. 14, when the sub-pixel 11 is not selected, the potential $V_{11}$ of the sub-pixel 11 maintains the potential applied to the sub-pixel 11 when being selected. That is, in either case whether the common connection line COM (i) is connected to the wiring 36A or the wiring 36B, the potential $V_{11}$ of the sub-pixel 11 is not changed, and only the potential of the common connection line COM (i) is changed. Accordingly, the display luminance of the sub-pixel 11 is constant all the time when the pixel 11 is not selected.

In addition, similarly to the case of the above embodiment, for example, the second common connection line may be connected to the wiring 36A only in the beginning of the period indicated by A of FIG. 14 (for example, only in the period of B1 of FIG. 14), and the second common connection line may be connected to the wiring 36B in the remainder of the period indicated by A of FIG. 14 (for example, in the period of B2 of FIG. 14). For example, the second common connection line may be connected to the wiring 36A only in the end of the period indicated by A of FIG. 14 (for example, only in the period of C1 of FIG. 14), and the second common connection line may be connected to the wiring 36B in the remainder of the period indicated by A of FIG. 14 (for example, in the period of C2 of FIG. 14). For example, the second common connection line may be connected to the wiring 36A only in the period (for example, in the period of D2 of FIG. 14) obtained by subtracting the period when the auxiliary pulse is output to the second common connection line from the period corresponding to the one frame period interposing the period (for example, the period of D3 of FIG. 3) when the auxiliary pulse is output from the auxiliary pulse generating device 37 to the second common connection line, and the second common connection line may be connected to the wiring 36B in the period (for example, in the period of D1 of FIG. 3) before and after that period.

Also in this embodiment, the common connection line drive circuit 35 electrically separates, from each other, the one common connection line COM (first common connection line) arranged corresponding to the sub-pixels 11 to be selected, and the plurality of common connection lines COM (second common connection lines) arranged corresponding to the sub-pixels 11 not to be selected of the horizontal lines different from the horizontal line including the sub-pixels 11 to be selected, and at least the two horizontal lines adjacent to each other. For example, as illustrated in FIG. 16, the common connection line drive circuit 35 electrically separates, from each other, the one common connection line COM (i+1) arranged corresponding to the sub-pixels 11R (1, i+1), 11G (2, i+1), 11B (3, i+1), and 11B (X, i) to be selected, and the three common connection lines COM (i−2), COM (i−1), and COM (i) arranged corresponding to the three horizontal lines including the sub-pixels 11R (1, i−2), 11R (1, i−1), and 11R (1, i) not to be selected.

Moreover, in this embodiment, the common connection line drive circuit 35 electrically connects the plurality of second common connection lines to each other, and independently drives the first common connection line and the second common connection lines from each other. For example, as illustrated in FIG. 16, the common connection line drive circuit 35 electrically connects the three common connection lines COM (i−2), COM (i−1), and COM (i) to each other, and independently drives the three common connection lines COM (i−2), COM (i−1), and COM (i), and the one common connection line COM (i+1) from each other.

Thereby, in comparison with the case where the common electrode for all the sub-pixels 11 is provided, it is possible to reduce the capacity during driving. In the sub-pixels 11 not to be selected, the potential difference is not generated between the second common connection lines during the period when the potential applied to the corresponding sub-pixels 11 is maintained. Thereby, it is possible to perform the charge/discharge of the common connection line COM at high speed while suppressing both the power consumption and the light leakage low.

The potential of the first common connection line and the potential of the second common connection line are preferably not highly different. For example, the potential of the first common connection line may be 5 V, and the potential of the second common connection line may be 2.5 V which is larger than 0 V. In this case, since the large electric field in the lateral direction is not generated between the first common connection line and the second common connection line, it is possible to reduce the light leakage in this part.

In this embodiment, the common connection line drive circuit 35 preferably electrically separates, from each other, the first common connection line, and the common connection lines COM (third common connection lines) arranged corresponding to the sub-pixels 11 not to be selected belonging to all the horizontal lines different from the horizontal line including the sub-pixel 11 to be selected. For example, as illustrated in FIG. 16, the common connection line drive circuit 35 electrically separates, from each other, the one common connection line COM (i+1) arranged corresponding to the sub-pixels 11R (1, i+1), 11G (2, i+1), 11B (3, i+1), and 11B (X, i+1) to be selected, and the three common connection lines COM (i−2), COM (i−1), and COM (i) arranged corresponding to the three horizontal lines including the sub-pixels 11R (1, i−2), 11R (1, i−1), and 11R (1, i) not to be selected.

Thereby, the influence from the sub-pixel 11 not to be selected is hardly propagated to the sub-pixel 11 to be selected. Moreover, in virtually all or in all the sub-pixels 11 not to be selected, the potential difference is not generated between the third common connection lines during the period when the voltage applied to the corresponding sub-pixels 11 is maintained. As a result, it is possible not only to further reduce the power consumption, but also virtually eliminate the light leakage. Moreover, since the charge/discharge of the common connection line COM may be performed at higher speed, it is possible to eliminate the risk that the deterioration of the image quality is generated due to the charge/discharge of the common connection line COM.

As illustrated in FIGS. 17 and 18, in this embodiment, when the signal line drive circuit 33 performs the frame inversion drive, the common connection line drive circuit 35 performs the common inversion drive in which the polarity of the voltage supplied to the common electrode (common connection line COM) is inverted for each frame period. For example, as illustrated in FIGS. 17 and 18, the common connection line drive circuit 35 inverts the polarity of the voltage applied to the sub-pixel 11 for each frame period so that the polarity of the sub-pixel 11 when the $n-1^{th}$ frame period is passed, and the polarity of the sub-pixel 11 when the $n^{th}$ frame period is passed are opposite from each other. Thereby, it is possible to reduce the amplitude of the signal voltage applied to the sub-pixel 11, and it is possible to further suppress the power consumption low.

In this embodiment, in the case where the common connection line drive circuit 35 allows the second common connection line or the third common connection line to become floating for the predetermine time, the wiring capacity of the signal line DTL and the common connection line COM is drastically reduced, and thus it is possible to further suppress the power consumption low.

Also in this embodiment, various modifications as illustrated in FIGS. 8 to 11 may be made.

The present application contains subject matter related to that disclosed in Japanese Priority Patent Application JP 2009-103933 filed in the Japan Patent Office on Apr. 22, 2009, the entire contents of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A liquid crystal display device comprising:

a pixel array including a plurality of scanning lines arranged in rows, a plurality of signal lines arranged in columns, a plurality of liquid crystal elements arranged in a matrix corresponding to an intersection of each scanning line and each signal line, and a plurality of common connection lines arranged one by one corresponding to the liquid crystal elements of each line, the plurality of common connection lines including one or a plurality of first common connection lines and a plurality of second common connection lines;

a scanning line drive circuit configured to sequentially apply a selection pulse to the plurality of scanning lines, and sequentially select the plurality of liquid crystal elements in a unit of the scanning line;

a signal line drive circuit configured to apply a signal potential $V_{sig}$ corresponding to a video signal to each signal line, and write the signal potential $V_{sig}$ in the liquid crystal elements to be selected, the liquid crystal elements to have the same potential $V_{sig}$ relative to a potential of the corresponding common connection line from the moment that the liquid crystal elements stop being selected;

a switching element arranged to correspond to each of the common connection lines, the switching element having (i) a first output terminal configured to switch a connection between each of the common connection lines and an auxiliary pulse generating device, and (ii) a second output terminal configured to switch a connection between each of the common connection lines and a logic circuit; and a common connection line drive circuit configured to (i) connect the one or the plurality of the first common connection lines to the auxiliary pulse generating device by the first output terminal, (ii) connect the plurality of second common connection lines to the logic circuit by the second output terminal, (iii) electrically separate the one or the plurality of first common connection lines from the plurality of second common connection lines, and (iv) electrically connect the plurality of second common connection lines to each other to independently drive the one or the plurality of first common connection lines and the plurality of second common connection lines from each other, wherein, the one or the plurality of first common connection lines are arranged to correspond to the liquid crystal elements to be selected, and the plurality of second common connection lines are arranged to correspond to the liquid crystal elements not to be selected, and include at least two lines adjacent to each other.

2. The liquid crystal display device according to claim 1, wherein the common connection line drive circuit electrically separates, from each other, the first common connection line and third common connection lines arranged corresponding to the liquid crystal elements not to be selected belonging to all the lines different from the line including the liquid crystal elements to be selected.

3. The liquid crystal display device according to claim 2, wherein the common connection line drive circuit allows the third common connection line to become floating for a predetermined time.

4. The liquid crystal display device according to claim 2, wherein the common connection line drive circuit applies a predetermined potential to the third common connection line for a predetermined time.

5. The liquid crystal display device according to claim 1, wherein the common connection drive line circuit allows the third common connection line to become floating for a predetermined time, and applies a predetermined potential to the third common connection line for the predetermined time in a period other than the predetermined time when the third common connection line becomes floating.

6. The liquid crystal display device according to claim 2, wherein the liquid crystal elements selected by the one scanning line in the plurality of liquid crystal elements are arranged in rows.

7. The liquid crystal display device of claim 1, wherein the common connection line drive circuit allows the second common connection lines to become floating for a predetermined time.

8. The liquid crystal display device according to claim 1, wherein the common connection line drive circuit applies a predetermined potential to the second common connection line for a predetermined time.

9. The liquid crystal display device according to claim 1, wherein the common connection drive line circuit allows the second common connection line to become floating for a predetermined time, and applies a predetermined potential to the second common connection line for the predetermined time in a period other than the predetermined time when the second common connection line becomes floating.

10. The liquid crystal display device according to claim 1, wherein the liquid crystal elements selected by the one scanning line in the plurality of liquid crystal elements are alternately arranged.

11. The liquid crystal display device according to claim 1, wherein the signal line drive circuit applies, to each signal line, a signal potential in which a potential is inverted to a reference potential for each frame period, and writes the signal potential in the liquid crystal element to be selected.

12. The liquid crystal display device according to claim 11, wherein the common connection line drive circuit applies, to the common connection line corresponding to the liquid crystal element to be selected, a potential in which a polarity to the reference potential is opposite from a polarity to the reference potential in the signal line.

13. The liquid crystal display device of claim 1, wherein a potential difference is not generated between any two of the second common connection lines.

14. The liquid crystal display device of claim 1, wherein a potential of the first common connection lines is not highly different from a potential of the second common connection lines.

15. The liquid crystal display device of claim 14, wherein the potential of the first common connection lines is 5V and the potential of the second common connection lines is 2.5V.

* * * * *